United States Patent [19]

Weller et al.

[11] 4,188,905

[45] Feb. 19, 1980

[54] MINE SWEEPING MEANS

[75] Inventors: Royal Weller, Pullman, Wash.; Harry S. Jones, Washington, D.C.

[73] Assignee: The United States of America as represented by the Secretary of the Navy, Washington, D.C.

[21] Appl. No.: 482,855

[22] Filed: Apr. 13, 1943

[51] Int. Cl.[2] ..... B63G 8/42; B63B 21/56

[52] U.S. Cl. ..... 114/253; 114/244; 102/18 MS

[58] Field of Search ..... 114/235, 235.1, 235.2, 114/240, 240.1, 240.2, 240.3, 240.4, 240.5, 209

[56] References Cited

U.S. PATENT DOCUMENTS

| | | | |
|---|---|---|---|
| 346,689 | 8/1886 | Schoening | 114/145 R |
| 728,330 | 5/1903 | Temperley et al. | 114/215 X |
| 818,479 | 4/1906 | Sjostrand | 114/244 |
| 990,596 | 4/1911 | Rosvold | 114/311 |
| 1,012,890 | 12/1911 | Miller | 114/311 |
| 1,094,700 | 4/1914 | Bundgens | 114/244 |
| 1,285,558 | 11/1918 | Campbell | 114/311 |
| 1,305,483 | 6/1919 | Matsumura | 114/244 |
| 2,270,694 | 1/1942 | Yancey | 114/221 A |

*Primary Examiner*—David H. Brown
*Attorney, Agent, or Firm*—R. S. Sciascia; A. L. Branning

EXEMPLARY CLAIM

1. In a mechanism for sweeping a pressure controlled mine arranged within a body of water comprising a plurality of water entraining devices, each of said devices comprising a pair of pressure plates, a plurality of bracing members for maintaining the pressure plates of each pair in predetermined fixed space relation with respect to each other, a plurality of flexible tension members interconnecting said pairs of pressure plates whereby the plates are adapted to cause the water entrained between said plates to be moved sufficiently to reduce the pressure of the water adjacent the mine to a predetermined value as the mechanism travels over the mine, and means for causing movement of said mechanism above the mine.

2 Claims, 8 Drawing Figures

MINE SWEEPING MEANS

The invention herein described and claimed may be manufactured and used by and for the Government of the United States of America for governmental purposes without payment of any royalties thereon or therefor.

This invention relates to means for sweeping a pressure controlled mine. More specifically, this invention relates to means for varying the hydrostatic pressure within a body of water adjacent a mine for a period of time sufficient to fire the mine.

Certain types of mines, referred to herein as pressure controlled mines are adapted to be fired by a predetermined reduction in the pressure of the surrounding water such, for example, as the reduction in pressure caused by the movement of a vessel above the mine. The mines are usually provided with an electro-responsive detonator operatively connected to a firing circuit adapted to be closed when the reduction in pressure of the water has been continuously maintained for a predetermined period of time thereby to prevent the premature detonation of the mines by pressure variations within the water as the result of the action of waves. The mines are also provided with certain pressure controlled devices adapted to initiate a cycle of operations of the mine firing mechanism in response to a relatively rapid decrease in the pressure of the surrounding water thereby preventing the premature firing of the mines as the result of relatively slow variations in the pressure of the water due to tides.

The present invention comprises an arrangement of connected baffle plates adapted to be towed through the water by a vessel, hereinafter referred to as a mine sweeper, thereby setting up an area of reduced pressure within the water beneath the baffle plates sufficient to operate the firing mechanism of a pressure controlled mine disposed adjacent the path of travel of the plates and to thereby fire the mine, this method of exploding a mine being referred to herein as mine sweeping.

It has been the general practice heretofore in sweeping pressure controlled mines to employ a relatively large wooden vessel or barge for setting up the variation in pressure within the water necessary to fire the mine, the barge being usually towed or pushed through the water by a mine sweeper at a rate of travel sufficient to effect a reduction in pressure of the water under the vessel thus firing the mine. With this arrangement it has been found that the explosion of the mine usually causes damage or destruction of the vessel or barge by reason of the relatively large exposed surface thereof beneath the water within the destructive area of the mine.

By employing a plurality of connected plates or baffles in the manner herein disclosed, a relatively inexpensive and simple mechanism is provided for reducing the pressure of the water adjacent the mine in which the damage to the pressure reducing mechanism as the result of the explosion of the mine is reduced to a minimum and in which the damaged portions of the mechanism may be quickly and easily replaced from a supply of these parts carried by the mine sweeper without substantial interruption of the mine sweeping operations.

One of the objects of the present invention is the provision of new and improved means for sweeping a pressure controlled mine which is economical to manufacture, reliable in operation and which possesses all of the qualities of ruggedness and durability in service.

Another of the objects is the provision of a sweeping mechanism for pressure controlled mines which may be quickly and easily restored to an initial operating condition in the event of damage thereto as the result of the explosion of the mine.

Still another object is the provision of a new and improved sweeping device for pressure controlled mines in which means are provided for varying at will the period of time during which the pressure of the water is reduced by a predetermined amount opposite a fixed point of reference within the water.

Still other objects, advantages and improvements will be apparent from the following description taken in connection with the accompanying drawings of which:

Figure 1:
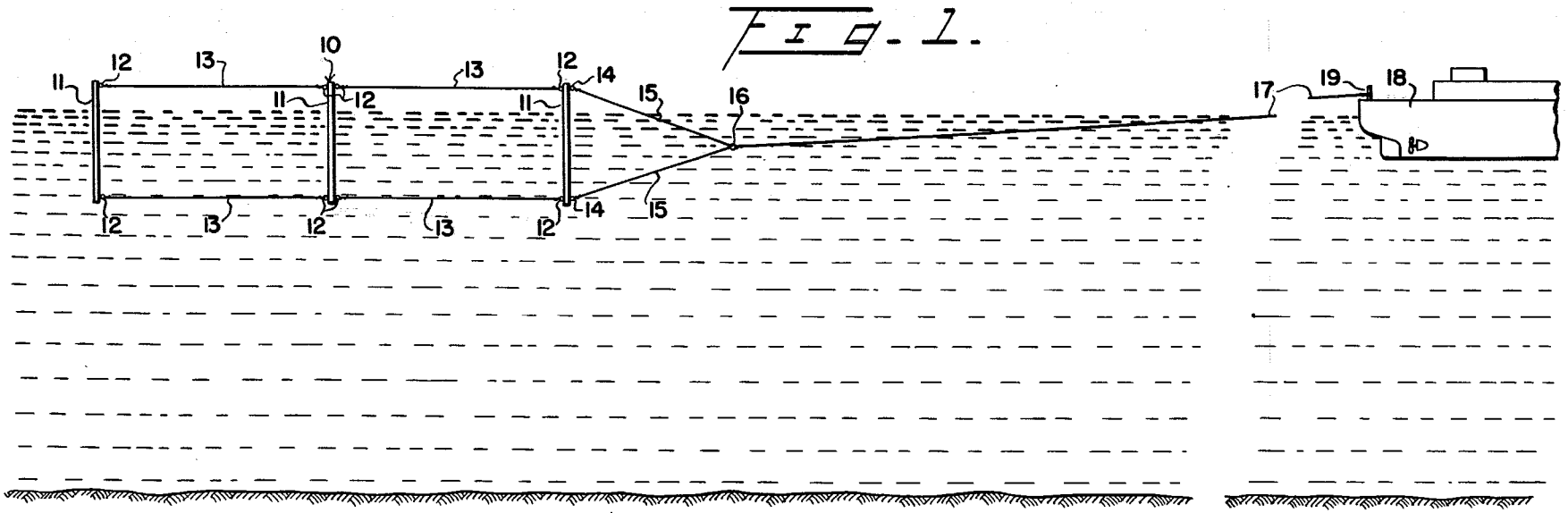
FIGS. 1 and 2 are diagrammatic views in elevation and plan respectively of a preferred embodiment of the invention.
Figure 2:
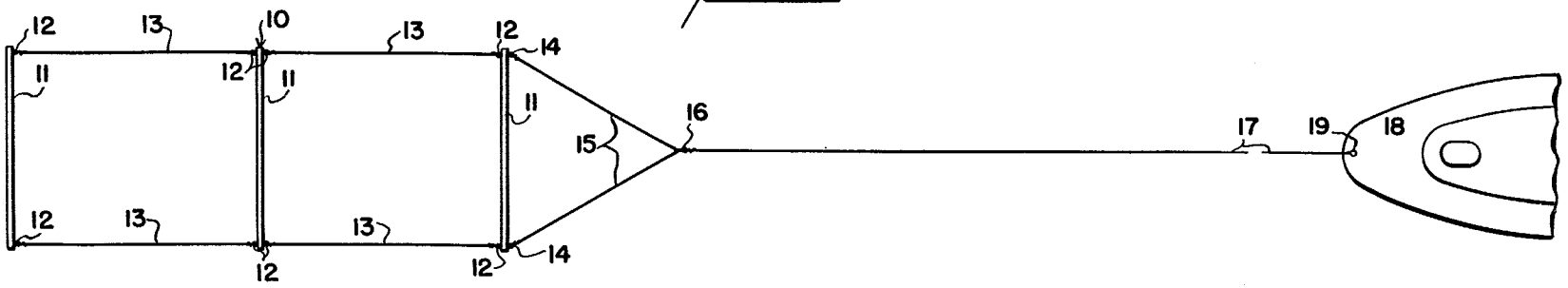

Referring now to the drawings and more particularly to FIGS. 1 and 2 thereof there is shown thereon in diagrammatic form a mine sweeping device in accordance with a preferred embodiment of the invention indicated generally by the numeral 10 comprising a plurality of baffle plates 11 preferably of substantially the width of the vessel whose pressure signature is to be simulated. The plates are preferably of somewhat greater depth than the vessel to be simulated and are composed of any material suitable for the purpose such, for example, as wood whereby the buoyancy of the plates is positive in character and the plates, therefore, are adapted to sink within the water to a depth of submersion corresponding substantially to the draft of the simulated vessel.

Each of the plates is provided with a plurality of eye bolts 12 to which are secured the flexible cables or guys 13. The leading plate is also provided with a plurality of eye bolts 14 to which is secured a towing chain or cable 15 preferably provided with a shackle 16 to which is secured the towing cable 17 at one end thereof, the opposite end of the towing cable being secured as at 19 to a mine sweeper 18 smaller than the simulated vessel. An arrangement is thus provided in which the plates 11 are adapted to be towed through the water by the mine sweeper at a predetermined depth of submersion corresponding generally to the draft of the vessel, the pressure signature of which is simulated by the plates as the plates are towed through the water by the mine sweeper.

Figure 3:
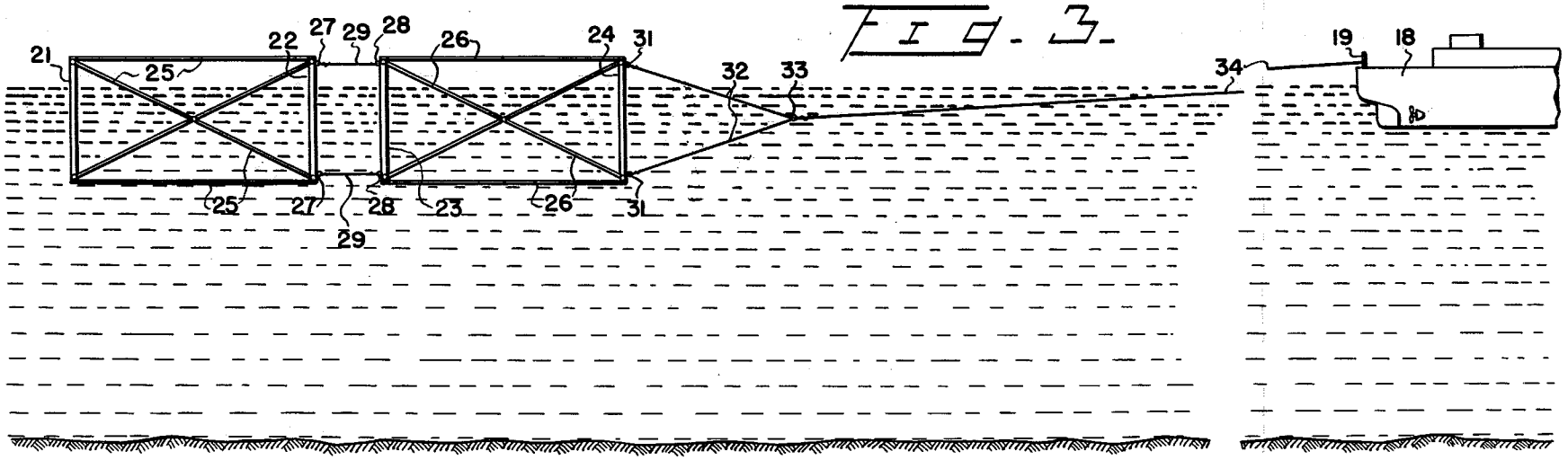
FIGS. 3 and 4 are diagrammatic views in elevation and plan respectively showing a modified form of the invention.
Figure 4:
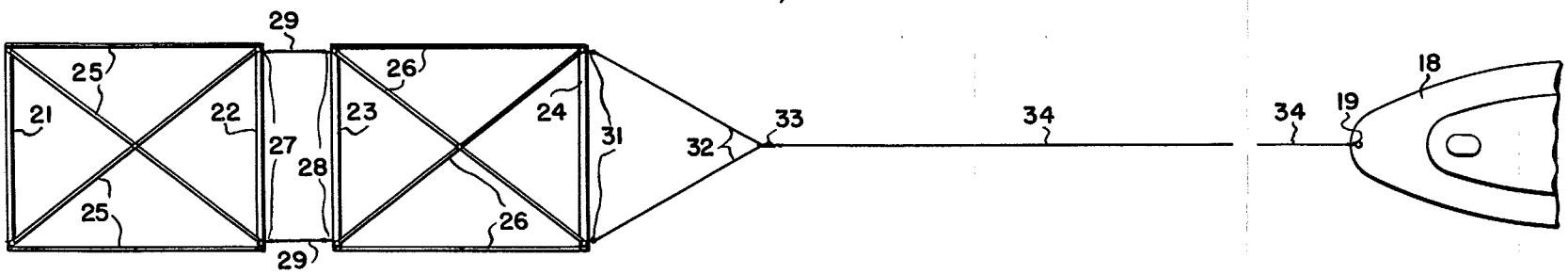

On FIGS. 3 and 4 is shown in diagrammatic form a modified form of the invention comprising a plurality of pairs of plates 21, 22, 23 and 24 employed to effect a predetermined reduction in the pressure of the water beneath the plates. The plates 21 and 22 are connected together by a plurality of rigid bracing members 25 thereby to form a box-like structure in which the plates 21 and 22 form the ends of the structure and the top, bottom and both sides of the structure are not enclosed except for the bracing members. In a similar manner the plates 23 and 24 are rigidly connected in predetermined space relation with respect to each other by the rigid braces 26. Each of the plates 22 and 23 is provided with a plurality of eye bolts 27 and 28 respectively whereby the plates 22 and 23 are connected together as by the flexible cables or chains 29.

The plate 24 is provided with a plurality of eye bolts 31 which are connected to a towing chain or cable 32 having a shackle or eye 33 secured thereto to which is attached one end of the towing cable 34. The other end of the towing cable is secured to the mine sweeper 18 as at 19.

Figure 5:
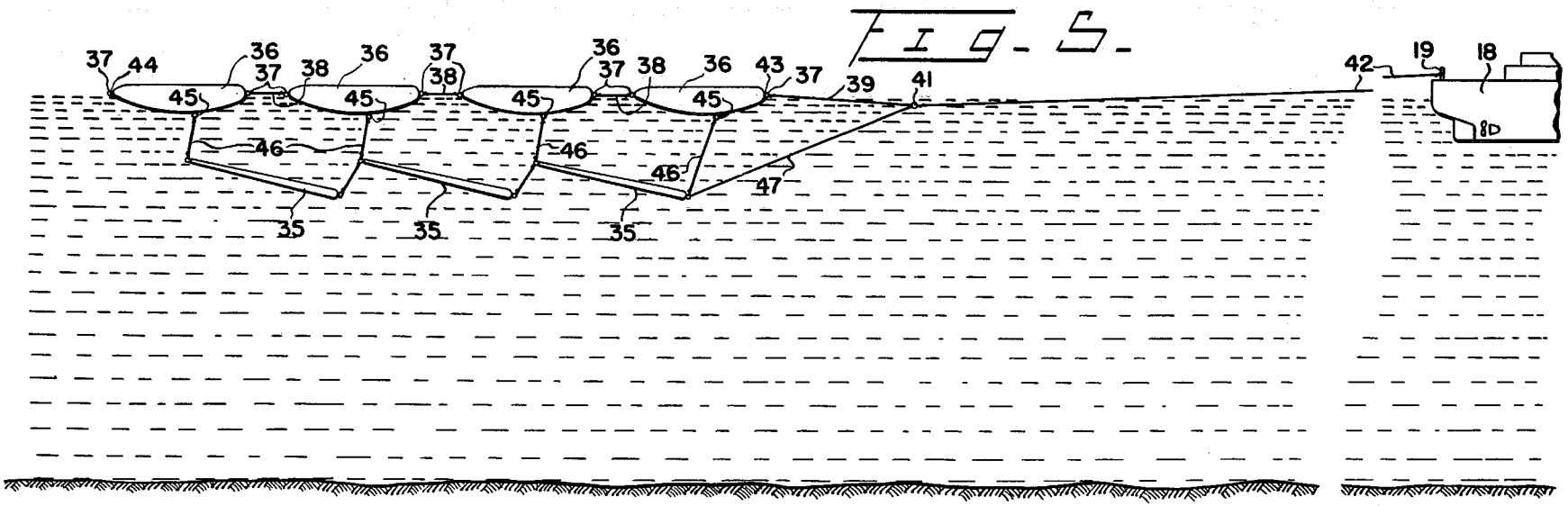
FIGS. 5 and 6 illustrate diagrammatically in elevation and plan respectively still another modified form of the invention.
Figure 6:
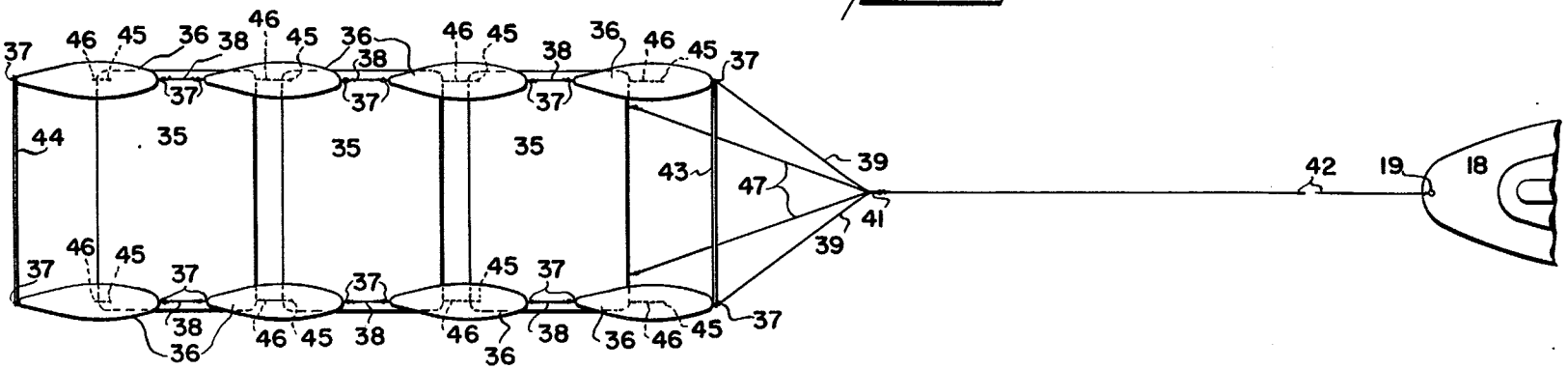

On FIGS. 5 and 6 is shown in diagrammatic form in elevation and plan respectively still another modified form of the invention in which the baffle plates 35 are supported within the water by a plurality of floats 36 in such a manner that the plates 35 are inclined at an angle with respect to the surface of the water. Each of the floats is provided with a plurality of eye bolts 37 whereby the bolts are connected together by the flexible cables or chains 38. The eye bolts of the front end of the leading floats are connected to a towing bridle or chain 39 having a shackle or eye 41 therein to which is secured the towing line or cable 42 at one end thereof, the opposite end of the towing cable being secured to the mine sweeper 18 as at 19. The front ends of each of the leading floats are maintained in predetermined space relation with respect to each other by a rigid spacing member 43 secured thereto and in like manner the trailing ends of the rear floats are maintained in predetermined space relation with respect to each other by the spacing member 44, preferably of the same length as the spacing member 43 whereby the floats 36 are adapted to be towed through the water in two parallel alined arrays by the mine sweeper 18.

Secured to each of the floats as by an eye bolt 45 arranged on the under side thereof is a plurality of cables or chains 46 to which is secured in any suitable manner the ends of the plates 35, the trailing end of each of the plates being connected to the cables 46 at a point somewhat nearer the eye bolt 45 of the next succeeding float whereby the floats are arranged within the water at an angle with respect to the surface of the water substantially as illustrated. The leading end of the first plate is connected as by the towing bridle 47 to the aforesaid shackle 41 thereby providing an arrangement in which the floats and pressure plates supported thereby are adapted to be towed through the water by the bridles 39 and 47 connected to the mine sweeper as by the towing cable 42.

Figure 7:
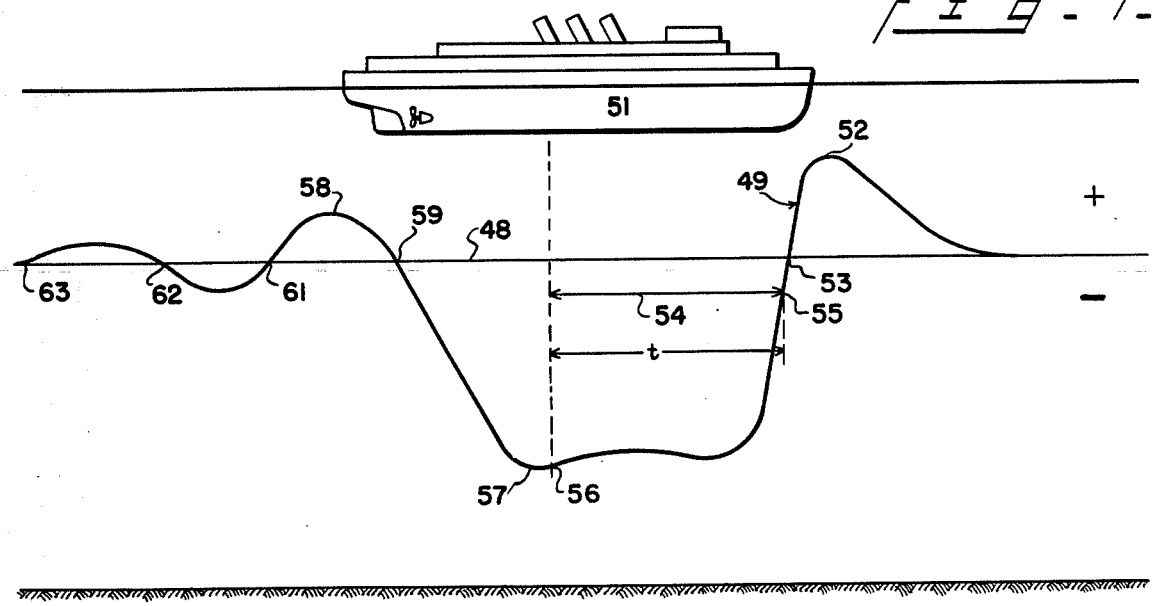
FIG. 7 shows in diagrammatic form the variation in the pressure of the water as a vessel moves across a point of reference; and, FIG. 8 shows in diagrammatic form the variation in the pressure of the water as the sweep device of the present invention moves across a point of reference.
Figure 8:
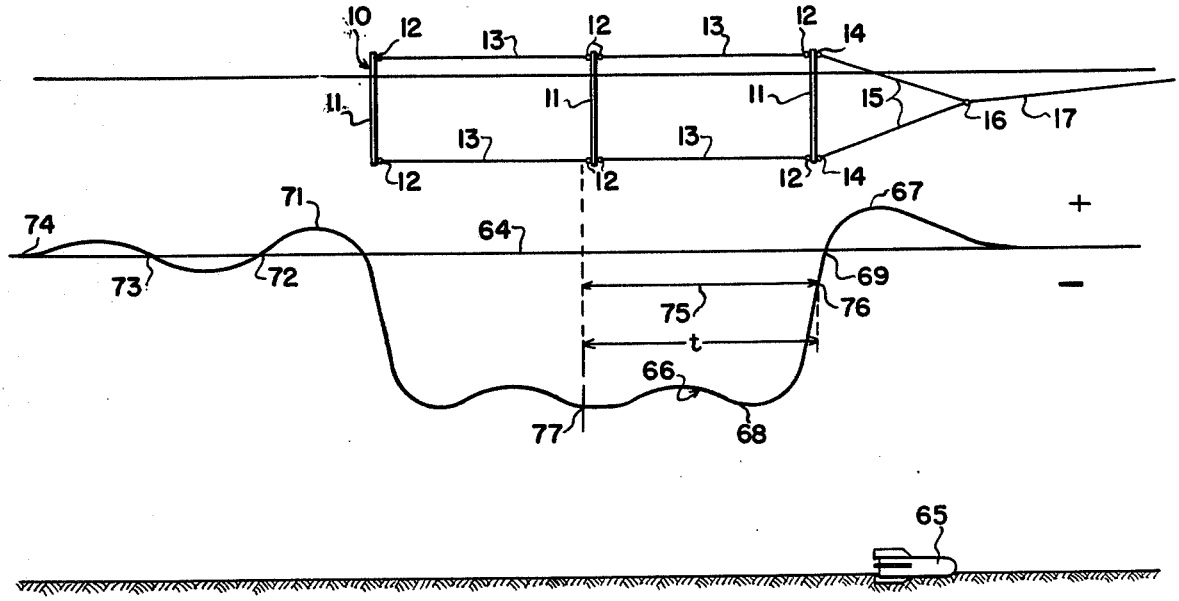

The operation of the mechanism will best be understood by reference to FIGS. 7 and 8 on which is shown in diagrammatic form the variations in the pressure of the water caused by the movement of the vessel and of the sweeping mechanism of the present invention according to the preferred embodiment thereof respectively. It has been found that the movement of a vessel through the water causes a frontal wave of pressure within the water to precede the vessel and, as the vessel moves across the point of reference, this wave of pressure changes relatively rapidly to a wave of pressure less than the pressure of the surrounding water. For the purpose of description the frontal wave of pressure may be regarded as positive and the wave of reduced pressure immediately following the frontal wave may be regarded as negative in character. When the aft portion of the vessel moves across the point of reference the pressure is changed from negative to positive and thereafter may pass through several cycles or reversals of positive to negative pressure and vice versa of decreasing magnitude. This variation in the pressure of the water is referred to herein as the pressure signature of a vessel.

As is well known in the art of hydromechanics, a unit volume of any fluid possesses energy of position, kinetic energy and energy due to compression. The total energy of the unit volume of fluid is constant and an essential balance is continuously present between kinetic energy and potential energy over every part of a stream in steady flow. This statement sets forth the law of Bernoulli's theorem and since the total energy is constant, an increase in one of the other factors must be accompanied by a decrease in one or both of the remaining factors. As the vessel moves through the water, the water is caused to flow reversely beneath the vessel from the bow toward the stern thereof and the increase in the kinetic energy of the water as a result of movement of the vessel, therefore, is accompanied by a decrease in the pressure of the water beneath the vessel which is in a state of flow, it being understood that the total energy of the water remains substantially constant.

On FIG. 7 the pressure of the water at the point of observation when a vessel is within the vicinity of the observation point is indicated by the line 48, the curve 49 being employed to indicate graphically the pressure signature of the vessel corresponding to variations in the pressure of the water at a fixed point of reference as the vessel 51 moves across the reference point. The pressure of the water, it will be noted, is increased positively as the vessel approaches the point of reference until the point 52 on the curve 49 is reached, this point being just ahead of the bow of the vessel. As the bow of the vessel continues to move past the point of reference the pressure of the water decreases rapidly, the pressure becoming negative as the point 53 on the curve 49 is reached.

If it be assumed, by way of example, that the mine is adapted to be fired by a reduction in the pressure of the water of at least a value indicated by the line 54 when the pressure has been reduced continuously to at least this value for a time t, the reduction in pressure required to actuate the mine firing control mechanism occurs at the point 55 of the curve 49 and is continuously maintained at a negative value of pressure less than the decrease in pressure required to fire the mine until the point 56 on the curve 49 is reached at which time the mine is exploded beneath a vulnerable portion of the vessel. In the event, however, that a mine is not disposed within the path of travel of the vessel, the continued movement of the vessel 51 forward causes the pressure of the water to be decreased until the portion of the vessel just ahead of the propellers is reached, this portion of the vessel corresponding to the point 57 of the curve 49.

As the vessel continues to move past the point of reference the pressure of the water is increased at the point 57 of the curve 49 until the point 58 is reached, the pressure of the water changing from negative to positive at the point 59 of the curve 49. The pressure of the water oscillates as the vessel moves away from the point of reference, the pressure being negative during that portion of the curve between the points 61 and 62 thereof and positive in character between the points 62 and 63, the oscillations in the pressure decreasing in amplitude as the vessel continues to move away from the point of reference.

On FIG. 8 the pressure of the water at the point of observation is indicated by the line 64 when the pressure of the water is unchanged by a ponderous mass or by a pressure changing device moving within the vicinity of an observation point such, for example, as the mine 65 illustrated. The curve 66 is employed to indicate graphically the pressure signature corresponding to the variations in the pressure of the water at the point of reference as the mine sweeping device 10 of FIG. 1 is towed across the point of reference by a mine sweeper. As the mine sweeping device approaches the point of reference the pressure of the water is increased as at 67, and thereafter reduced until the point 68 on the curve 66 is reached, the pressure changing from positive to negative as the curve 66 crosses the line 64 at the point 69, the point 69 being substantially beneath the forward or leading plate of the mine sweeping device. As the last of the plates 11 passes over the point of reference the pressure of the water is increased, the pressure increasing to a positive value at 71 when the last plate 11 has moved past the reference point. As the mine sweeping device continues to move beyond the reference point the pressure of the water is varied from positive to negative values, the pressure being negative during that portion of the curve between the points 72 and 73 thereof and the pressure being positive between the points 73 and 74.

If it be assumed, for the purpose of description, that the firing control mechanism of the mine 65 is adapted to be set in operation at a negative value of pressure indicated by the line 75 and the mine is adapted to be fired when the pressure of the surrounding water has been maintained continuously at a reduced pressure such, for example, as the pressure represented by the line 75 for a period of time t, it will be understood that the mine 65 is actuated as the point of the curve 66 is reached and fired opposite the point 77 of the curve 66, the explosion forcing the water upwardly between the plates of the mine sweeping device with a minimum of damage thereto.

Whereas, in the illustrative embodiment of the invention of FIG. 8, the mine sweeping device is composed of three baffles or pressure plates connected together by suitable lengths of flexible cable or chain, it will be understood that this has been done for the purpose of illustration and that, if desired, a greater or lesser number of plates may be employed, it being merely necessary to provide a sufficient number of plates to maintain the reduction in the pressure of the water adjacent the mine 65 below a predetermined value continously for a period of time t thereby to insure that the mine would be swept by the aforesaid mine sweeping device. Also it will be noted that the plates may be connected by cables of greater or lesser length as desired, it being merely necessary to entrain sufficient water between the plates to insure a continuous reduction in the pressure of the water therebeneath of less pressure than the pressure graphically represented by the line 75.

Whereas on FIGS. 5 and 6 there is shown an arrangement comprising a plurality of plates supported by floats whereby the plates are arranged at an angle with respect to the surface of the water, it will be understood that this arrangement of plates and floats is adapted to set up an area of reduced pressure therebeneath as the plates are towed through the water by causing a mass of water to be entrained and forced upwardly above the plates. When the arrangement of FIGS. 3 and 4 is employed, the reduction in pressure in the water beneath the mine sweeping device causes the pressure controlled firing mechanism of a mine, such as the mine 65, to be set in operation for a time sufficient to cause the mine to explode. Whereas in FIGS. 3 and 4 the arrangement disclosed comprises two box-like structures having pairs of plates or baffles respectively connected together by rigid bracing members, the box-like structures being interconnected by lengths of cable or chains 29, it will, of course, be understood that this is by way of illustration only as, if desired, the device may comprise a greater or lesser number of box-like structures connected together by suitable lengths of cable or chain. Furthermore, each of the box-like structures may employ additional plates or baffles arranged intermediate the end plates thereof thereby more efficiently to entrain the mass of water within the device.

Briefly stated in summary, the present invention contemplates the provision of means including a plurality of plates or baffles for entraining and/or lifting a mass of water as the plates are towed through a body of water by a vessel whereby an area of reduced pressure is set up beneath the plates for a period of time sufficient to fire a pressure controlled mine without damage or injury to the towing vessel, in which the damage to the towed mechanism as a result of the explosion of the mine is of such minor nature that it may be easily and quickly repaired and the mine sweeping operations may be resumed without leaving the scene of the explosion.

While the invention has been described with respect to several particular examples thereof which give satisfactory results, it will be understood by those skilled in the art to which the invention pertains, after understanding the invention, that various changes and modifications may be employed without departing from the spirit and scope of the invention and it is our intention, therefore, in the appended claims to cover all such changes and modifications.

What is claimed as new and desired to be secured by Letters Patent of the United States is:

1. In a mechanism for sweeping a pressure controlled mine arranged within a body of water comprising a plurality of water entraining devices, each of said devices comprising a pair of pressure plates, a plurality of bracing members for maintaining the pressure plates of each pair in predetermined fixed space relation with respect to each other, a plurality of flexible tension members interconnecting said pairs of pressure plates whereby the plates are adapted to cause the water entrained between said plates to be moved sufficiently to reduce the pressure of the water adjacent the mine to a predetermined value as the mechanism travels over the mine, and means for causing movement of said mechanism above the mine.

2. In a device of the character disclosed for sweeping a pressure controlled mine arranged within a body of water, in combination, two groups of floats, means for connecting the floats of each group together in predetermined space relation whereby the floats are adapted to be moved in succession past the mine, means including a plurality of rigid members for maintaining the floats of each of said groups in continuous predetermined space relation as the floats are moved through the water, a plurality of pressure plates arranged within the water beneath said floats and operatively connected thereto, a towing connection secured to each of said groups of floats and to the first of said pressure plates, and means including a line secured to said towing connection for towing the floats and pressure plates through the water with a force sufficient to fire the mine.

* * * * *